US011498651B2

(12) United States Patent
Rhyne et al.

(10) Patent No.: US 11,498,651 B2
(45) Date of Patent: Nov. 15, 2022

(54) PERSONAL HAND AND FOOT OPERATED WATERCRAFT

(71) Applicant: Ellipticraft, LLC, Falls Church, VA (US)

(72) Inventors: Joseph Rhyne, Falls Church, VA (US); Carly Rhyne, Falls Church, VA (US)

(73) Assignee: Ellipticraft, LLC, Falls Church, VA (US)

( * ) Notice: Subject to any disclaimer, the term of this patent is extended or adjusted under 35 U.S.C. 154(b) by 110 days.

(21) Appl. No.: 17/175,878

(22) Filed: Feb. 15, 2021

(65) Prior Publication Data

US 2021/0394881 A1 Dec. 23, 2021

Related U.S. Application Data

(60) Provisional application No. 63/040,703, filed on Jun. 18, 2020.

(51) Int. Cl.

| | |
|---|---|
| ***B63H 16/04*** | (2006.01) |
| ***B63B 1/12*** | (2006.01) |
| ***B63H 16/20*** | (2006.01) |
| ***B63B 34/50*** | (2020.01) |
| ***B63B 29/04*** | (2006.01) |
| *B63H 16/18* | (2006.01) |

(52) U.S. Cl.

CPC ..... *B63H 16/04* (2013.01); *B63B 1/121* (2013.01); *B63B 29/04* (2013.01); *B63B 34/50* (2020.02); *B63H 16/20* (2013.01); *B63B 2029/043* (2013.01); *B63H 16/18* (2013.01); *B63H 2016/202* (2013.01)

(58) Field of Classification Search

CPC ..... B63H 16/04; B63H 16/20; B63H 16/18; B63H 2016/202; B63B 1/121; B63B 34/50; B63B 29/04; B63B 2029/043

See application file for complete search history.

(56) References Cited

U.S. PATENT DOCUMENTS

| | | | |
|---|---|---|---|
| 3,084,356 | A | 4/1963 | Wheat |
| 4,804,345 | A | 2/1989 | Lee |
| 5,213,528 | A | 5/1993 | Seiford, Sr. |
| 5,368,507 | A | 11/1994 | Harris |

(Continued)

*Primary Examiner* — S. Joseph Morano
*Assistant Examiner* — Jovon E Hayes
(74) *Attorney, Agent, or Firm* — Carter, DeLuca & Farrell LLP

(57) ABSTRACT

A watercraft includes at least one floating member, a central frame supported thereon, first and second foot platforms, and first and second handlebars. The first and second handlebars define elongated configurations and include grasping end portions, intermediate portions pivotably coupled to the central frame, and base end portions pivotably coupled to first end portions of the respective first and second foot platforms. A propulsion system includes an axle assembly, first and second rotating arms, and first and second oars. The rotating arms are fixed relative to one another, pivotably coupled about the axle assembly at first ends, and pivotably coupled to second end portions of the foot platforms at second ends. The oars are engaged with and extend from the foot platforms. The propulsion system cycles the oars approximately 180 degrees out of phase to propel the watercraft while maintaining substantially perpendicular orientation of the oars.

14 Claims, 6 Drawing Sheets

(56) References Cited

U.S. PATENT DOCUMENTS

| | | | | | |
|---|---|---|---|---|---|
| 5,702,274 | A * | 12/1997 | White | B63H 16/20 | 440/24 |
| 5,921,824 | A * | 7/1999 | Ilagan | B63H 16/12 | 440/26 |
| 6,213,830 | B1 | 4/2001 | Robinson | | |
| 6,595,813 | B1 * | 7/2003 | Lekhtman | B63B 34/52 | 441/76 |
| 6,764,363 | B2 | 7/2004 | Rosen | | |
| 6,855,024 | B2 * | 2/2005 | Rothschild | B63B 34/56 | 441/77 |
| 7,121,910 | B2 | 10/2006 | Rosen | | |
| 7,264,521 | B2 * | 9/2007 | Gardner | B63H 16/12 | 441/27 |
| 7,371,138 | B2 | 5/2008 | Spass | | |
| 7,607,959 | B2 | 10/2009 | DeMint | | |
| 8,043,134 | B2 | 10/2011 | Krah | | |
| 8,074,304 | B1 | 12/2011 | Snyder | | |
| 8,167,667 | B2 * | 5/2012 | Sturm | B63B 34/00 | 440/32 |
| 8,408,954 | B2 * | 4/2013 | Sturm | B63H 16/12 | 440/32 |
| 8,992,272 | B1 * | 3/2015 | Malakiman | B63H 16/18 | 440/32 |
| 9,051,038 | B1 * | 6/2015 | Herber | B63H 16/18 | |
| 9,365,272 | B1 | 6/2016 | Foglia | | |
| 9,403,585 | B2 * | 8/2016 | Arad | B63H 16/20 | |
| 9,475,559 | B2 * | 10/2016 | Czarnowski | B63B 32/64 | |
| 9,738,129 | B2 * | 8/2017 | Dovel | B63H 16/12 | |
| 2013/0157529 | A1 * | 6/2013 | Santa Catarina | B63H 16/12 | 482/52 |
| 2020/0047864 | A1 * | 2/2020 | Myer | B63H 16/18 | |

* cited by examiner

PERSONAL HAND AND FOOT OPERATED WATERCRAFT

CROSS-REFERENCE TO RELATED APPLICATIONS

This application claims the benefit of U.S. Provisional Patent Application No. 63/040,703, filed on Jun. 18, 2020, the entire contents of which are hereby incorporated herein by reference.

FIELD

The present disclosure relates to watercraft and, more particularly, to personal human powered watercraft.

BACKGROUND

For thousands of years, human beings have been drawn to the water and sought its use for recreation and restoration as well as navigation. In particular, the concept of walking on water—from the ancient story of Orion to Jesus' walk across the Galilee—has inspired, fascinated, and perplexed mankind. Accordingly, a wide variety of human powered watercraft attempting to emulate walking on water are known in the prior art.

However, prior art watercraft attempting to emulate walking on water suffer from one or more disadvantages such as, for example: they do not allow the user to apply the full force of the natural walking motion to operate the watercraft; they require complex, expensive propulsion components and/or mechanisms; they are prone to break down in aquatic environments; they are cumbersome and difficult to operate; they require a high level of physical exertion without achieving high levels of speed; and/or they are not sufficiently portable to enable use by an individual.

More specifically, some devices contemplate the use of foot skis or floating water shoes combined with poles operated by the users arm for balance. These devices, however, are difficult to operate, present balancing issues, and produce significant drag that minimizes efficiency. In other approaches, propulsion systems have been added to paddle boards to increase both speed and stability. These watercraft are sometimes referred to as stand up peddle boards. However, such devices do not allow the user to utilize both their hands and feet to give the sensation of walking or running on water and, as a result, the full potential energy created by the walking or running motion is not converted to motive power.

Still other devices employ propellers required to continuously turn at a high rate of speed to create forward motion; as such, propeller systems are most efficient when coupled with a motor or, under manual power, when a gear system is implemented to enable the propeller to achieve sufficient speed. Such gear systems are complex and prone to breakage and degradation in aquatic environments.

Paddle wheel powered watercrafts are large and boxy, increasing the weight of the watercraft, thereby making disassembly, transport, and launch difficult. Paddle wheels powered watercrafts also create a large amount of splash and drag and do not allow the user to engage their arms to power the watercraft. Feathered paddle wheel powered watercrafts are similarly ill suited for personal watercraft as they are large, heavy, and/or contain multiple components which are prone to damage and degradation in water.

SUMMARY

The present disclosure provides a personal watercraft which, through its structure, speed, and ease of use, gives the user the sense of walking or running on water. The personal watercraft of the present disclosure, more specifically, converts elliptical style hand and foot motion to direct forward propulsion on the water in an efficient manner while being packaged in a simple, compact, and easily portable design to enable an individual user to transport the watercraft to and from the water environment of their choice. Aspects and features of the present disclosure are detailed below; to the extent consistent, any or all of the aspects and features detailed herein may be utilized in conjunction with any or all of the other aspects and features detailed herein.

Provided in accordance with aspects of the present disclosure is a watercraft including at least one floating member configured to float in a body of water, a central frame supported on and connected to the at least one floating member, first and second foot platforms oriented substantially horizontally and configured to support feet of a user, first and second handlebars, and a propulsion system. The first and second foot platforms define first and second end portions, respectively. The first and second handlebars are oriented substantially vertically and define elongated configurations including grasping end portions configured to be grasped by hands of a user, intermediate portions pivotably coupled to the central frame, and base end portions pivotably coupled to the first end portions of the respective first and second foot platforms. The propulsion system includes an axle assembly, first and second rotating arms each having a first end portion and a second end portion, and first and second oars. The first end portions of the first and second rotation arms are fixed relative to one another and pivotably coupled about the axle assembly while the second end portions of the first and second rotating arms are pivotably coupled to the second end portions of the first and second foot platforms, respectively. The first and second oars are engaged with the first and second foot platforms, respectively, towards the second end portions thereof, and depend from first and second foot platforms, respectively. The propulsion system is configured such that, upon activation, the first and second oars are cycled in and out of the body of water, approximately 180 degrees out of phase with respect to one another, to propel the watercraft along a surface of the body of water. The first and second oars are maintained in substantially perpendicular orientation relative to the surface of the body of water throughout the cycle of motion thereof.

In an aspect of the present disclosure, the second end portions of the first and second foot platforms are disposed towards a rear end portion of the watercraft such that the first and second rotating arms are disposed towards the rear end portion of the watercraft.

In another aspect of the present disclosure, the first end portions of the first and second foot platforms are disposed towards a front end portion of the watercraft such that the first and second handlebars are disposed towards the front end portion of the watercraft.

In still another aspect of the present disclosure, the at least one floating member includes a pair of spaced-apart pontoons. Additionally or alternatively, the at least one floating member is formed from at least one of: a rigid roto-molded material, a rigid aluminum material, or an inflatable material.

In yet another aspect of the present disclosure, the central frame further includes at least one of a cup holder or a storage compartment attached thereto.

In still yet another aspect of the present disclosure, the watercraft further includes a substantially vertical elongated member rotatably coupled to the central frame and including a rudder at a base end portion thereof. In such aspects, a grasping end portion of the substantially vertical elongated member may be disposed between the first and second handlebars to facilitate rotational manipulation thereof by a user. Alternatively or additionally, a stabilization fin may depend from the rudder in substantially perpendicular orientation relative thereto.

In another aspect of the present disclosure, the first and second oars are adjustably engaged with the first and second foot platforms, respectively, to enable adjustment of depths the first and second oars depend from the first and second foot platforms, respectively.

In yet another aspect of the present disclosure, the watercraft further includes a seat mounted on the central frame.

In still another aspect of the present disclosure, activation includes alternatingly moving the grasping end portions of the first and second handlebars in back and forth motions and/or moving the first and second foot platforms in rotational motions rotating the first and second rotating arms about the axle assembly approximately 180 degrees out of phase relative to one another.

BRIEF DESCRIPTION OF THE DRAWINGS

The above and other aspects and features of the present disclosure will become more apparent in light of the following detailed description when taken in conjunction with the accompanying drawings wherein like reference numerals identify similar or identical elements.

DETAILED DESCRIPTION

Figure 1:
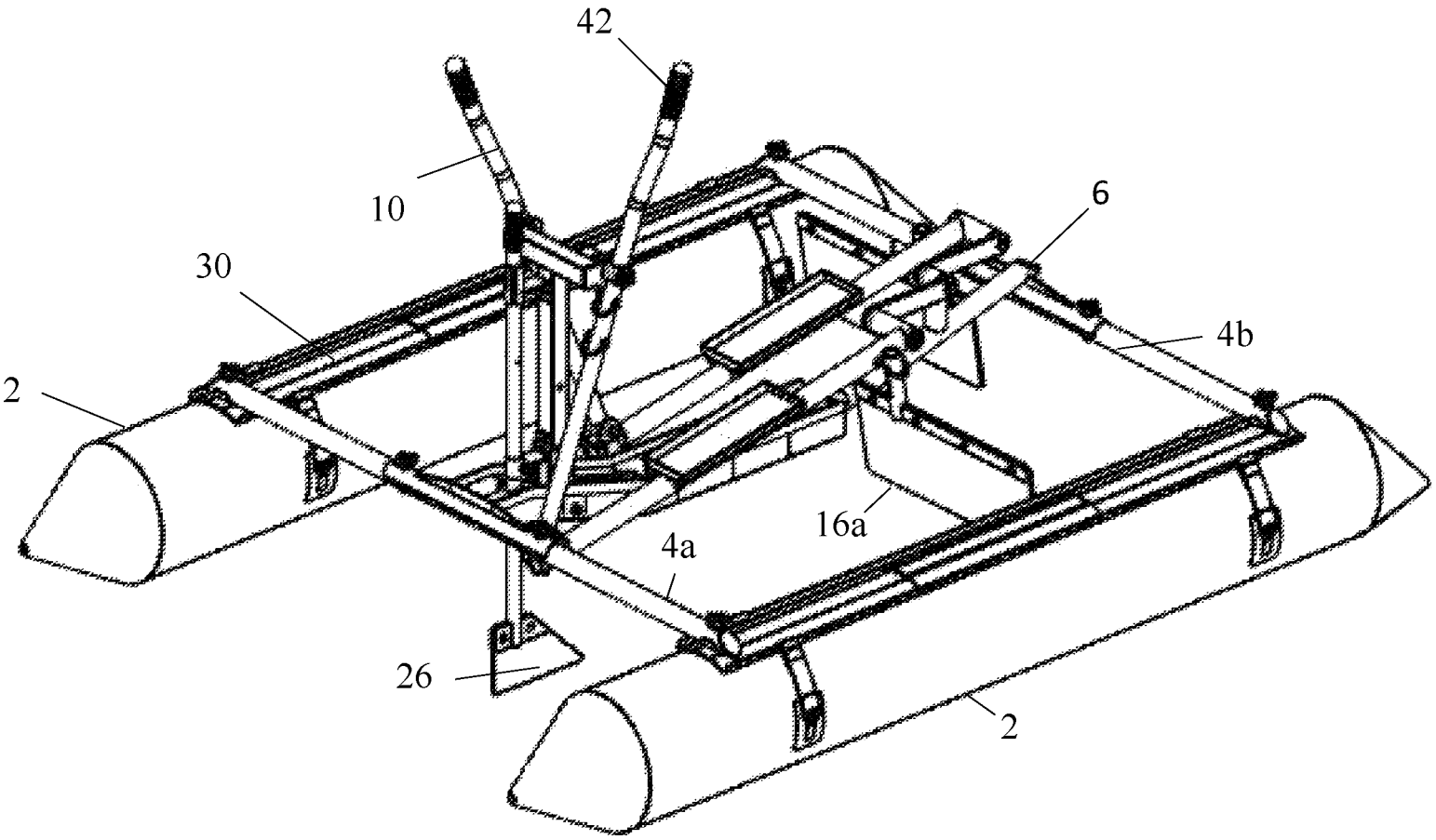
FIG. 1 is a perspective view of a personal watercraft provided in accordance with the present disclosure.
Figure 2:
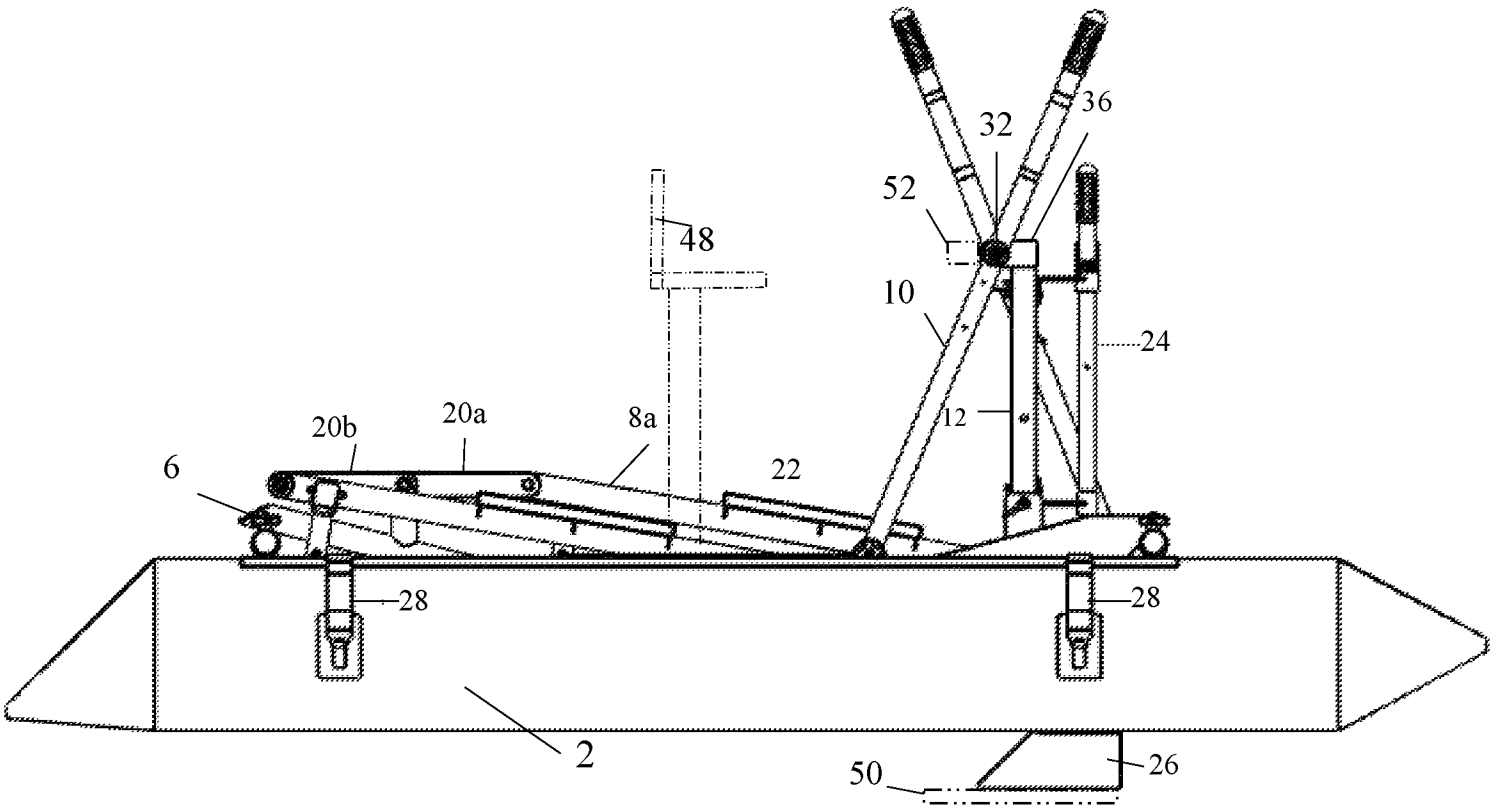
FIG. 2 is a side view of the watercraft of FIG. 1.
Figure 3:
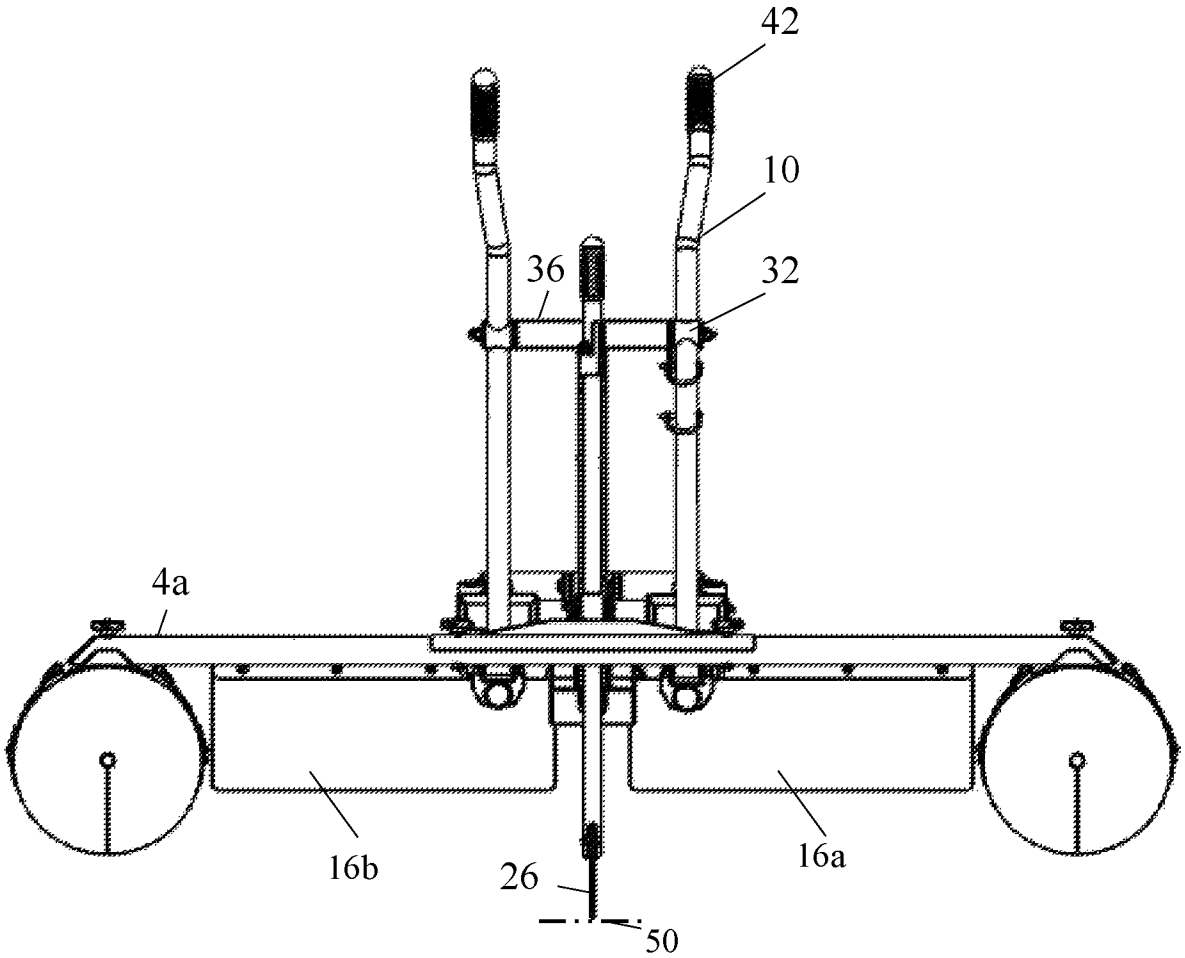
FIG. 3 is a front view of the watercraft of FIG. 1.
Figure 4:
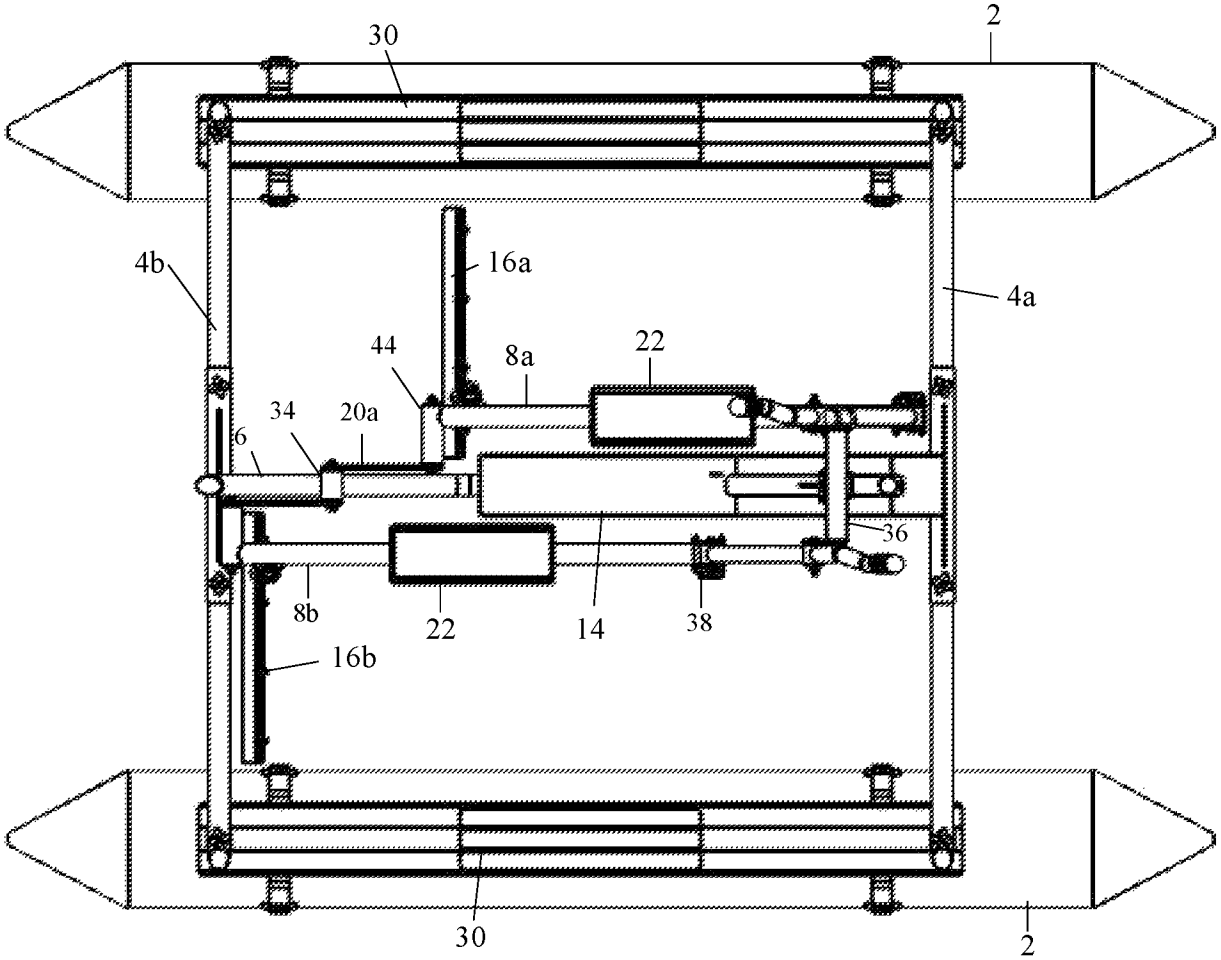
FIG. 4 is a top view of the watercraft of FIG. 1.
Figure 5:
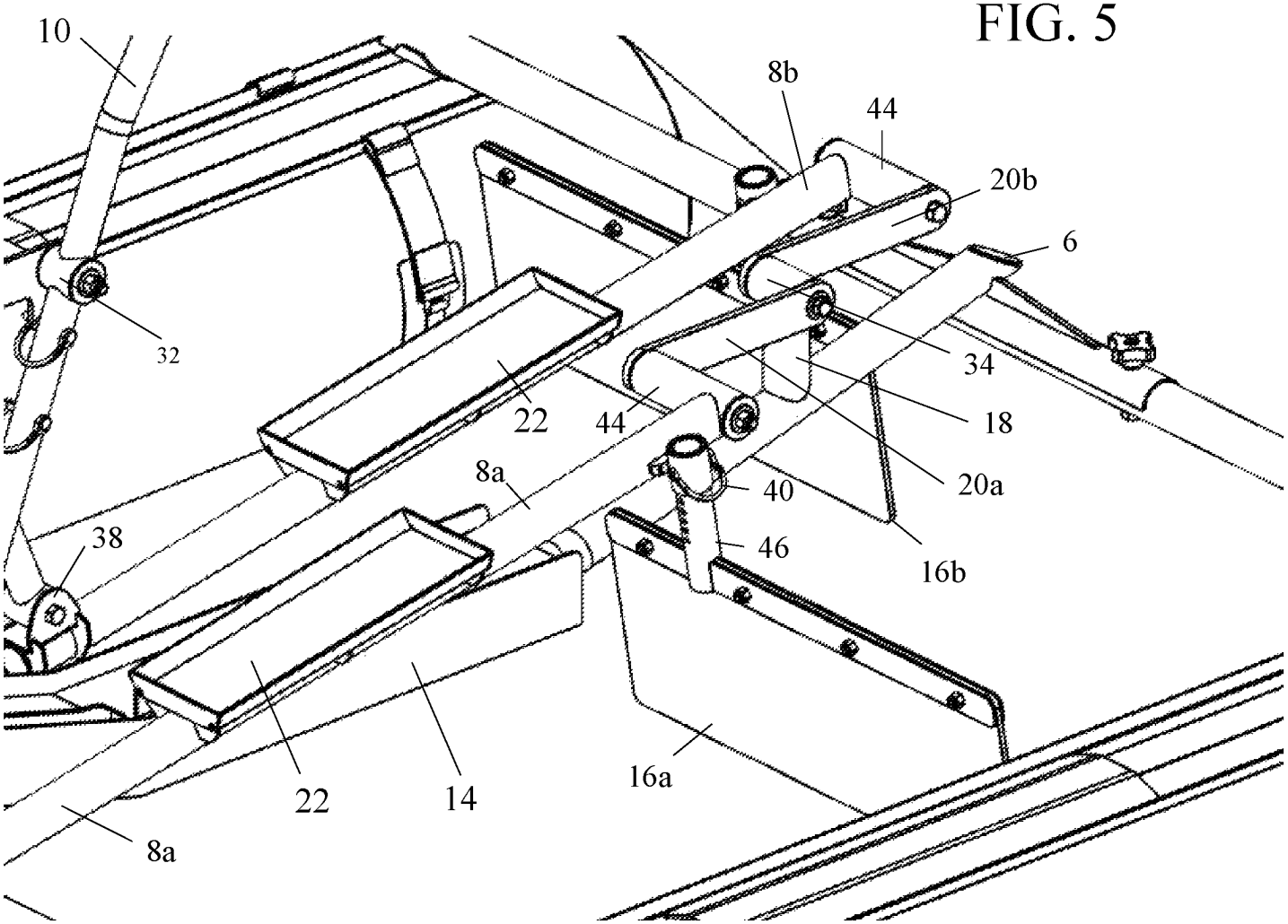
FIG. 5 is an enlarged, perspective view of a walking oar propulsion system of the watercraft of FIG. 1.
Figure 6:
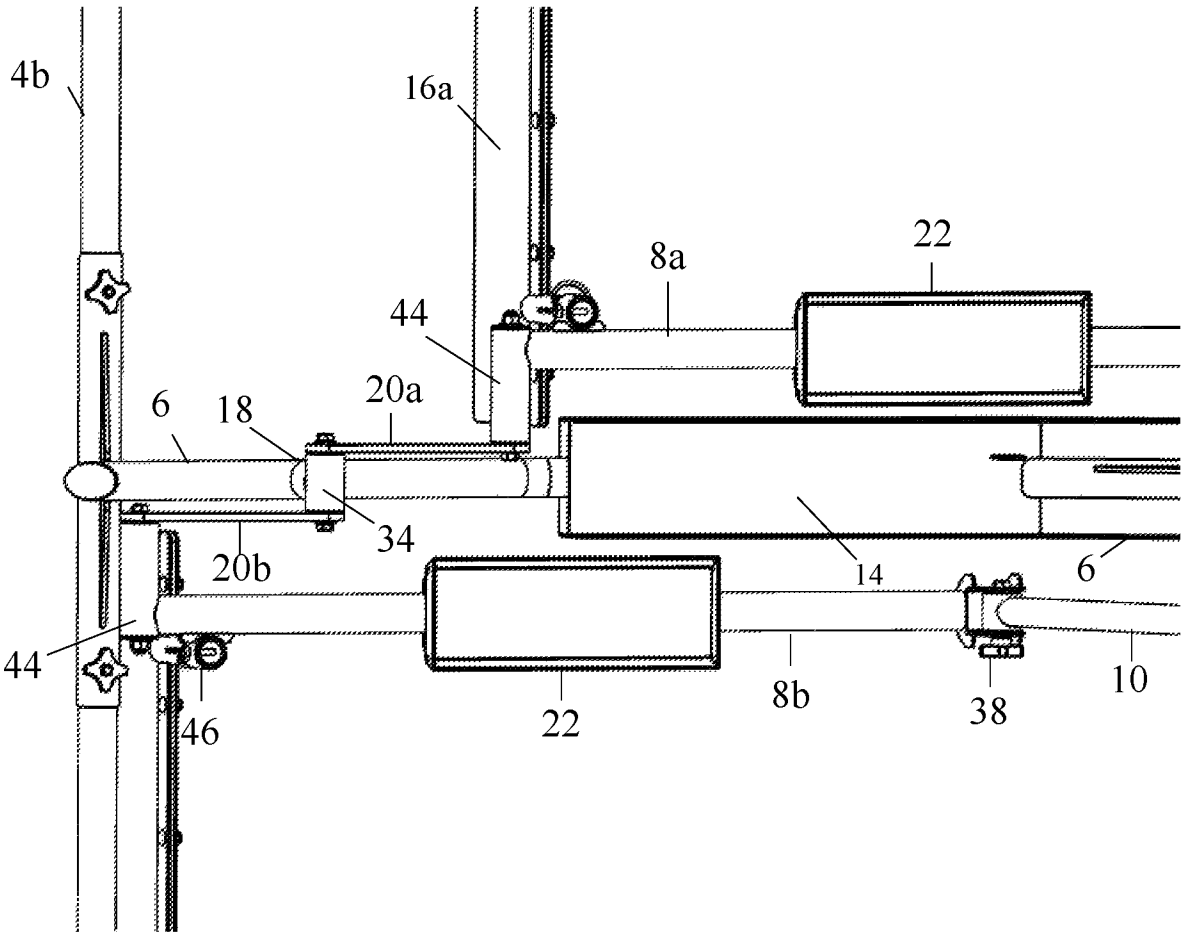
FIG. 6 is a top view of the walking oar propulsion system of the of the watercraft of FIG. 1.

A watercraft in accordance with the present disclosure is illustrated in FIGS. 1-4. FIGS. 5-6 provide a close up view of a walking oar propulsion system of the watercraft, as detailed below. Referring to FIGS. 1-4, the watercraft includes two floating members 2, such as pontoons, that provide floatation for the watercraft. A central frame, components of which are detailed below, rests on top of the floating members 2 to connect the floating members 2 and provide the basic structure for the watercraft. In aspects, the central frame consists of two crossbars 4*a*, 4*b*, a central bar 6, a stand 14, an upshaft 12, and two struts 30. The struts 30 may be long flat elongated rigid pieces which rest on top of the floating members 2. The struts resemble saddles in aspects, and may have a concave shape which matches the arc of the top of the floating members 2. The two crossbars 4*a*, 4*b* may be elongated narrow rigid poles and may attach substantially perpendicularly to the struts 30 at the front and rear end portions of the watercraft using bolts or other suitable attachment mechanisms. The central bar 6 may be an elongated rigid member that is positioned substantially parallel to the struts 30 and floating members 2 and may be attached at each of its terminal points to the approximate midpoint of each crossbar 4*a*, 4*b*. In aspects, the central bar 6 has the structure of a fork with two tines, having the shape of a pole at its connection point to the rear crossbar 4*b* and two bar shaped tines near the front crossbar 4*a*. The space between the two tines of the central bar 6 provides a gap to accommodate other portions of the watercraft which are detailed below. The stand 14 may consist of flat rectangular surface of sufficient size to accommodate a suitable range of human sizes in a standing position and is mounted atop the central bar 6 at its approximate midpoint. The upshaft 12 may be a vertical pillar that is sandwiched by the front tines of the central bar 6 and proximate to the intersection of the front crossbar 4*a* and the central bar 6. A horizontal bar 36 of a length wider than the central bar 6 is mounted to the top of the upshaft 12 such that the upshaft 12 together with the horizontal bar 36 form the shape of a "T." In aspects, the straps 28 connect the struts 30 and the rest of the central frame to the floating members 2; however, other attachment mechanisms such as screws or welds may be utilized. In aspects, the components of the central frame include those detailed above and are made of aluminum, but those skilled in the art will understand that different combinations of struts, poles, or junctures as well as other materials such as carbon fiber, titanium, or rigid plastics to create a similar central frame may be utilized and is expressly contemplated by the present disclosure.

The watercraft further include two handlebars 10, which may be rigid narrow poles topped with handlebar grips 42 where a user's hands will go. The handlebars 10 are vertically oriented and pivotably attached to the horizontal bar 36 at either side of the horizontal bar 36 via the handlebar axle housings 32 (which are rotatably supported about axle rods (not shown)) at an approximate midpoint attachment, although other suitable intermediate attachments between the end portions of handlebars 10 are also contemplated, as are adjustable configurations of handlebars 10. The handlebar axle housings 32 permit each handlebar 10 to pivot, e.g., swing back and forth from the attachment point, e.g., the approximate midpoint attachment point, relative to the horizontal bar 36 and about the axle rods (not shown). Two foot platforms 8*a*, 8*b*, which may be rigid narrow tubular members oriented substantially horizontally, are connected at their forward end portions (forward terminal points, in aspects) to the base of the handlebars 10 using a pivot, e.g., hinge, attachment 38 or other suitable attachment. The pivot attachment 38 permits the foot platforms 8*a*, 8*b* to move up and down. Footings 22 are positioned atop the foot platforms 8*a*, 8*b*, each having a surface area of sufficient size to receive one foot of a user when operating the watercraft. In aspects, the footings 22 are flat and rectangular in shape, although other configurations may include different shaped footings and/or include footings that are adjustable in their position along the foot platforms 8*a*, 8*b*.

Referring to FIGS. 5 and 6, the walking oar propulsion system and its integration into the central frame is detailed, although it is understood that the walking oar propulsion system may be implemented in other central frames and/or other style watercrafts. The walking oar propulsion system includes an axle support 18, which may be a small rigid cylindrical component mounted fixedly atop the central bar 6 proximate to the rear crossbar 4*b*. An axle housing 34 has a similar width to the central bar 6 and is affixed to the top of the axle support 18. Two elongated arms, also referred to as rotating arms 20*a*, 20*b*, are connected, e.g., fixedly, at opposite sides to the axle rod (not shown), which is rotatably supported by bushings (not shown) within the axle housing 34. The rotating arms 20*a*, 20*b* are coupled via the axle assembly (the axle rod and bushings (not shown), the axle housing 34, and the axle support 18) so that the left rotating arm 20*a* and right rotating arm 20*b* are fixed at a substantially 180 degree angle relative to each other. In other words, together both rotating arms 20*a*, 20*b* are aligned on a substantially straight line that defines the diameter of a rotational circle of the rotating arms 20*a*, 20*b*. The other terminal point of each rotating arm 20*a*, 20*b* is coupled to the rear end of a corresponding foot platform 8*a*, 8*b* at a foot platform axle assembly including an axle rod and bushings (not shown) rotatably supported within an axle housing 44. More specifically, the other terminal points of the rotating arms 20*a*, 20*b* are fixedly secured to the axle rods (not shown) while the rear ends of the foot platforms 8*a*, 8*b* are fixedly secured to the axle housings 44 (which, in turn, are rotatably supported about the axle rods). Thus, when a user pedals their feet to action the foot platforms 8*a*, 8*b*, the rotating arms 20*a*, 20*b* rotate fully and continuously in a circle (the rotational circle) about the axle housing 34 while maintaining the substantially 180 degree angle therebetween.

An oar 16*a*, 16*b* is attached below the base of each foot platform 8*a*, 8*b* using an oar mount 46. The oar mounts 46 enable mounting of the oars 16*a*, 16*b* to the foot platforms 8*a*, 8*b* and are positioned proximate the junctions of the respective rotating arms 20*a*, 20*b* and foot platforms 8*a*, 8*b*. The oars 16*a*, 16*b* may be relatively narrow flat rectangular shaped and/or may be made of plastic in aspects, although other oar shapes and materials may be used in other aspects. The oar mounts 46 are positioned at an approximate 90 degree angle with respect to the corresponding foot platform 8*a*, 8*b* and hold the respective oars 16*a*, 16*b* such that a longitudinal axis of each oar 16*a*, 16*b* is substantially perpendicular to the central bar 6 and such that the vertical axis of each oar 16*a*, 16*b* is approximately perpendicular to the water surface when the watercraft is afloat in a water environment. In aspects, the oar mounts 46 are attached to the foot platforms 8*a*, 8*b* using locking pins 40 which allow the distances of the oars 16*a*, 16*b* below the respective foot platforms 8*a*, 8*b* to be adjustable to optimize the submersion depth of the oars 16*a*, 16*b*. As such, a series of vertically-spaced pin holes are defined through the oar mounts 46 to enable receipt of the locking pins 40 to, in turn, set the submersion depth. Other configurations for enabling adjustment of the submersion depth include, for example, mechanisms to raise the height of the central bar 6 and/or crossbars 4, or alternative oar height adjustment mechanisms on the oar mounts 46, e.g., ratcheting mechanisms, screw-threaded mechanisms, etc.

Referring again to FIGS. 1-4, a rudder 26 is attached to the base of an elongated rudder shaft 24 to provide a steering mechanism for the watercraft. The rudder 26 and rudder shaft 24 are positioned such that the rudder 26 is beneath the water line and the rudder shaft 24 is proximate to the upshaft 12, permitting the user to adjust the rudder 26 direction with a hand or hands. In aspects, a stabilization fin 50 is mounted on the rudder 26, e.g., depending therefrom or otherwise positioned relative thereto, in substantially perpendicular orientation relative to the rudder 26. In aspects, the rudder 26 and stabilization fin 50 define an upside-down T-shaped configuration (when viewed from a front of the watercraft). The stabilization fin 50 may be a substantially rectangular plate-like structure or may define any other suitable configuration.

With general reference to FIGS. 1-6, to operate the watercraft, in aspects, a user places a foot on each of the footings 22, a hand on each of the handlebars 10, and moves their feet in an elliptical rotational motion while pulling and pushing the handlebars 10 with their arms in an alternating fashion. The cycling motion initiated by the footings 22 and handlebars 10 causes the foot platforms 8*a*, 8*b* to rotate, which in turn causes the rotating arms 20*a*, 20*b* to move in a circular motion about the axle housing 34. Because the foot platforms 8*a*, 8*b* are attached at pivots 38 to the handlebars 10 at their forward end portions (or endpoints) and are coupled at axle housings 44 to the rotating arm 20*a*, 20*b* at their rear end portions (or endpoints), the foot platforms 8*a*, 8*b* maintain a relatively stable horizontal orientation while traveling up, forward, down, and rearward in an elliptical-pattern rotational cycle. The oars 16*a*, 16*b* are mounted in a fixed position below the foot platforms 8*a*, 8*b*, and as such the oars 16*a*, 16*b* are also rotated up, forward, down, and rearward in a circle while maintaining a substantially perpendicular orientation to the water's surface. The opposing alignment of the rotating arms 20*a*, 20*b* about the axle housing 34 ensures that left and right rotating arms 20*a*, 20*b*, the foot platforms 8*a*, 8*b*, and the oars 16*a*, 16*b* always cycle asynchronously. For example, when the left rotating arm 20*a* is at the bottom of its rotational cycle, the left foot platform 8*a* is also at the bottom of its rotational arc and the left oar 16*a* is fully submerged in the water. When the left side elements are at their nadir as described above, the right rotating arm 20*b* is at the top of its rotational cycle, the right foot platform 8*b* is at the top of its rotational arc, and the right oar 16*b* is at its peak out of the water. At the point in the rotational cycle where the left oar 16*a* exits the water, the opposing right oar 16*b* will start to break the plane of the water surface in a direction of entering the water. Thus, when the handlebars 10 and foot platforms 8*a*, 8*b* are actioned by a user, the oars 16*s*, 16*b* are alternatively submerged and pushed through the water creating sustained thrust and propulsion. Each oar 16*a*, 16*b* always enters and exits the water at an approximately vertical angle relative to the water's surface and retains that vertical position as it is pushed through the water during the rotational cycle. The oar mounts 46 may be raised or lowered using the locking pins 40 to change the distance the oars 16*a*, 16*b* extend below the foot platforms 8*a*, 8*b*, as detailed above, to enable optimization of the submersion depth of the oars 16*a*, 16*b*, e.g., for users of different weights and/or other purposes. For example, a heavier user will cause greater submersion of the floating members 2 and consequently the components of the central frame will be closer to the water's surface. For a heavier user, the oar mounts 46 should be raised closer to the foot platforms 8*a*, 8*b* so that the oars 16*a*, 16*b* are still able to rotate fully out of the water at their apex. Conversely, for a lighter user, the oar mounts 46 should be lowered away from the foot platforms 8*a*, 8*b* to ensure the oars 16*a*, 16*b* are fully submerged in the water at the nadir of their respective rotational cycles. In this way, the efficiency of the thrust of the oars 16*a*, 16*b* is optimized.

In use, a user can pedal their feet forwards or backwards to achieve forward or backward propulsion, respectively. The user may also position the footings 22 in a neutral position such that one oar, e.g., oar 16*a*, has just exited the water while the other oar, e.g., oar 16*b*, just begins to enter the water to achieve a drifting or resting position in the water. The user may stop the watercraft by dropping and holding either footing 22 in the down position, such that one of the oars 16*a*, 16*b* is fully submerged and drag is created to stop the watercraft. To steer the watercraft, the user uses their hand or hands to rotate the rudder shaft 24, which in turn rotates the rudder 26 (and stabilization fin 50, where provided) beneath the waterline of the craft.

Other configurations to enable a user to operate the watercraft by actioning either only the handlebars 10 or only footings 22 exclusively are also contemplated. Such configurations, for example, may permit the watercraft to be adapted to users with certain disabilities and could be accomplished through additional stabilizers and/or other enhancements to the watercraft to ensure stability for these users. As a non-limiting example, a seat 48 may be integrally or removably mounted on a support (which itself may be integral or removable) extending upwardly from the central frame.

Additionally or alternatively, a console 52, e.g., including a cup holder, phone/keys storage, other suitable open or closable compartments, etc., extends rearwardly from the upshaft 12 of the central frame so as to be readily reachable by a user operating the watercraft. Storage compartments (open or closable) may also be mounted on or attachable to floats 2 and/or other portions of the central frame. Some or all of such storage compartments (whether part of or separate from console 52) may be water-tight when closed to protect a user's valuables from the water environment.

From the description above, a number of advantages of some or all aspects of the presently disclosed personal watercraft become evident including, without limitation:

A sensation of walking or running on water is achieved by the user through the structure, ease of use, and speed of the watercraft.

A "walking oar" propulsion system that achieves constant and efficient thrust with as few as two paddles and minimum components. The paddles maintain a substantially perpendicular orientation to the water's surface throughout their rotational cycle, maximizing propulsive efficiency and reducing splashing to the user.

The walking oar propulsion system is light weight, simple, durable, and inexpensive.

The walking oar propulsion system can also be used to assist users with entry and exit from the water, as the design allows for a user to action the foot platforms and use the oars as leverage to push off from a beach or shallow launching area.

The design of the watercraft is configurable to achieve a high level of portability. Some configurations may have inflatable pontoons that can be deflated for transport and reinflated for use. In aspects, the upshaft and central bar components may fold together and/or the crossbars, upshaft, foot platforms, and oars may be detachable. This permits a user to disassemble and/or fold the watercraft and transport it in a personal vehicle to a boat ramp or water entry point for use.

While the above description contains many specificities, these should not be construed as limitations on the scope, but rather as an exemplification of aspects of the same. Many other aspects are contemplated and within the scope of the present disclosure. For example, while the illustrated configuration includes a rear drive propulsion system (that is, the rotational axle and oars are positioned behind the user), a front drive system could also be provided by moving the rotating arms to the front of the craft below the handlebars. Likewise, while the illustrated configuration provides a catamaran design with two floating members, other configurations could place the foot platforms, handlebars, and walking oar propulsion system components within another hull shape, such as a kayak, canoe, row boat, or "v" shaped hull. Furthermore, different aspects could use floating members which are made of different materials, such as rotomolded plastic, aluminum, or inflatable material.

The illustrated configuration relies on the user operating from a standing position, but a small seat could be added in other configurations to allow the user to rest or to accommodate disabled users with limited use of their hands or feet. While oar height adjustment is described to enable achievement of optimal submersion for differently weighted users, in other configurations, the height of the crossbars may additionally or alternatively be adjusted to accomplish this feat. The illustrated configuration is such that the crossbars, upshaft, foot platforms and footings are easily detachable so that a user may disassemble the watercraft and transport it in a personal vehicle to a boat ramp or water entry point for use; however other configurations may provide alternative or additional disassembly points and/or may provide collapsible and/or folding structures in addition or as an alternative to disassembly to achieve portability. The oars in the aspects detailed above are flat rigid members, but other configurations may be provided such as differently shaped oars, oars with concave or convex faces instead of flat faces, oars with ribs or other features, oars at least partially made from flexible materials, etc.

What is claimed is:

1. A watercraft, comprising:

at least one floating member configured to float in a body of water;

a central frame supported on and connected to the at least one floating member;

first and second foot platforms oriented substantially horizontally and configured to support feet of a user, the first and second foot platforms defining first and second end portions, respectively;

first and second handlebars oriented substantially vertically, the first and second handlebars defining elongated configurations including grasping end portions configured to be grasped by hands of a user, intermediate portions pivotably coupled to the central frame, and base end portions pivotably coupled to the first end portions of the respective first and second foot platforms; and a propulsion system, including:

an axle assembly;

first and second rotating arms each having a first end portion and a second end portion, the first end portions of the first and second rotation arms fixed relative to one another and pivotably coupled about the axle assembly, the second end portions of the first and second rotating arms pivotably coupled to the second end portions of the first and second foot platforms, respectively; and first and second oars engaged with the first and second foot platforms, respectively, towards the second end portions thereof, the first and second oars depending from first and second foot platforms, respectively, wherein the propulsion system is configured such that, upon activation, the first and second oars are cycled in and out of the body of water, approximately 180 degrees out of phase with respect to one another, to propel the watercraft along a surface of the body of water, and wherein the first and second oars are maintained in substantially perpendicular orientation relative to the surface of the body of water throughout the cycle motion thereof.

2. The watercraft according claim 1, wherein the second end portions of the first and second foot platforms are disposed towards a rear end portion of the watercraft such that the first and second rotating arms are disposed towards the rear end portion of the watercraft.

3. The watercraft according to claim 2, wherein the first end portions of the first and second foot platforms are disposed towards a front end portion of the watercraft such that the first and second handlebars are disposed towards the front end portion of the watercraft.

4. The watercraft according to claim 1, wherein the at least one floating member includes a pair of spaced-apart pontoons.

5. The watercraft according to claim 1, wherein the at least one floating member is formed from at least one of: a rigid roto-molded material, a rigid aluminum material, or an inflatable material.

6. The watercraft according to claim 1, wherein the central frame further includes at least one of: a cup holder or a storage compartment attached thereto.

7. The watercraft according to claim 1, further comprising a substantially vertical elongated member rotatably coupled to the central frame and including a rudder at a base end portion thereof.

8. The watercraft according to claim 7, wherein a grasping end portion of the substantially vertical elongated member is disposed between the first and second handlebars to facilitate rotational manipulation thereof by a user.

9. The watercraft according to claim 7, further comprising a stabilization fin depending from the rudder and disposed in substantially perpendicular orientation relative thereto.

10. The watercraft according to claim 1, wherein the first and second oars are adjustably engaged with the first and second foot platforms, respectively, to enable adjustment of depths the first and second oars depend from the first and second foot platforms, respectively.

11. The watercraft according to claim 1, further comprising a seat mounted on the central frame.

12. The watercraft according to claim 1, wherein activation includes alternatingly moving the grasping end portions of the first and second handlebars in back and forth motions.

13. The watercraft according to claim 1, wherein activation includes moving the first and second foot platforms in rotational motions rotating the first and second rotating arms about the axle assembly approximately 180 degrees out of phase relative to one another.

14. The watercraft according to claim 1, wherein activation includes alternatingly moving the grasping end portions of the first and second handlebars in back and forth motions and moving the first and second foot platforms in rotational motions rotating the first and second rotating arms about the axle assembly approximately 180 degrees out of phase relative to one another.

* * * * *